US009708891B2

(12) United States Patent
Mitchell et al.

(10) Patent No.: US 9,708,891 B2
(45) Date of Patent: Jul. 18, 2017

(54) FLEXIBLE CASING GUIDE RUNNING TOOL

(71) Applicant: WWT International, Inc., Houston, TX (US)

(72) Inventors: Sarah Mitchell, Corona, CA (US); Duane Thomas Bloom, Anaheim, CA (US)

(73) Assignee: WWT North America Holdings, Inc., Houston, TX (US)

( * ) Notice: Subject to any disclaimer, the term of this patent is extended or adjusted under 35 U.S.C. 154(b) by 627 days.

(21) Appl. No.: 14/049,023

(22) Filed: Oct. 8, 2013

(65) Prior Publication Data

US 2014/0110098 A1 Apr. 24, 2014

Related U.S. Application Data

(60) Provisional application No. 61/717,941, filed on Oct. 24, 2012.

(51) Int. Cl.

| | |
|---|---|
| ***E21B 17/14*** | (2006.01) |
| ***E21B 41/00*** | (2006.01) |
| ***E21B 43/10*** | (2006.01) |

(52) U.S. Cl.

CPC ..... *E21B 41/00* (2013.01); *E21B 17/14* (2013.01); *E21B 43/10* (2013.01)

(58) Field of Classification Search

CPC ..... E21B 17/14; E21B 17/08; E21B 41/0035
See application file for complete search history.

(56) References Cited

U.S. PATENT DOCUMENTS

| | | | | |
|---|---|---|---|---|
| 2,352,744 | A | 7/1944 | Stoddard | |
| 2,811,208 | A * | 10/1957 | Eadie | E21B 21/10 166/222 |
| 3,266,577 | A | 8/1966 | Turner | |
| 4,402,551 | A * | 9/1983 | Wood | E21B 7/061 166/117.5 |
| 6,070,665 | A * | 6/2000 | Singleton | E21B 7/061 166/242.1 |
| 6,309,002 | B1 | 10/2001 | Bouligny | |
| 6,478,097 | B2 | 11/2002 | Bloom et al. | |
| 7,066,253 | B2 | 6/2006 | Baker | |
| 7,350,584 | B2 | 4/2008 | Simpson et al. | |
| 2002/0096368 | A1 | 7/2002 | Kirk et al. | |
| 2004/0129414 | A1 | 7/2004 | Kriesels | |

FOREIGN PATENT DOCUMENTS

| | | | |
|---|---|---|---|
| CN | 103321575 | A | 9/2013 |
| EP | 2 372 074 | A2 | 10/2011 |
| SU | 821681 | A1 | 4/1981 |

OTHER PUBLICATIONS

Patent Examination Report No. 1 with Search Information Statement (SIS) issued in parallel Australian Patent Application No. 2013245469; date of issue May 21, 2015; 5 pages.
Combined Search and Examination Report for UK Application No. 1318168.0, date of mailing Apr. 8, 2014, 5 pages.

* cited by examiner

*Primary Examiner* — Robert E Fuller
(74) *Attorney, Agent, or Firm* — Lewis Roca Rothgerber Christie LLP

(57) ABSTRACT

A flexible wellbore casing guide having a tubular body positioned at an end of a wellbore casing having a lower stiffness than the wellbore casing, the casing guide can be a section of fiber reinforced composite tubing.

26 Claims, 8 Drawing Sheets

DEFLECTION FORCE AT NOSE

DEFLECTION FORCE AT NOSE

FLEXIBLE CASING GUIDE RUNNING TOOL

CROSS-REFERENCE TO RELATED APPLICATION

This application claims priority to and the benefit of U.S. Provisional Application No. 61/717,941, filed Oct. 24, 2012 the contents of which are incorporated herein by reference.

BACKGROUND

The present invention is directed to a downhole tool, and more particularly to a flexible casing guide running tool.

In oil and gas exploration and production operations, bores are drilled to gain access to subsurface hydrocarbon-bearing formations. The bores are typically lined with steel tubing, known as tubing, casing or liner, depending upon diameter, location and function. The tubing is run into the drilled bore from the surface and suspended or secured in the bore by appropriate means, such as a casing or liner hanger. For casing, cement may then be introduced into the annulus between the tubing and the bore wall.

As the tubing is run into the bore, the tubing end will encounter irregularities and restrictions in the bore wall, for example ledges formed where the bore passes between different formations and areas where the bore diameter decreases due to swelling of the surrounding formation. Further, debris may collect in the bore, particularly in highly deviated or horizontal bores. Accordingly, the tubing end may be subject to wear and damage as the tubing is lowered into the bore. These difficulties may be alleviated by providing a 'shoe' on the tubing end. Examples of casing shoes of various forms are well known in the art.

Another problem that some drilling engineers have described is the difficulty of running casing through build sections. More specifically, there is difficulty in running large diameter casing through the build section of a well in moderate to so ft formations. The stiffness of the casing requires a significant force that must be generated at the casing shoe to cause the casing to bend to follow the curved section of the wellbore.

In one example, it is necessary to run steel casing with a 16.5 inch outside diameter (OD) and 14.8 inch inside diameter (ID) through a planned wellbore curvature of 1 to 2 deg/100 ft to an inclination of 62 degrees. FEA (finite element analysis) studies can be used to determine the force required to deflect the 16.5 inch steel casing described above through various curved wellbores.

Because wells cannot be drilled exactly as planned, and exhibit some deviation from the planned wellpath, a statistical analysis of similar wells indicates that a planned wellbore curvature of 1 to 2 deg/100 ft will likely result in a maximum measured curvature of 3 to 4 deg/100 ft, with an instantaneous maximum curvature of up to 6 to 8 deg/100 ft in some areas.

FIG. 1 illustrates the results of one of these FEA studies. A plot of the force required to deflect the casing through various curves is shown in FIG. 2.

In the example given above, a force of up to 15,100 lbs could be required to deflect the casing through a maximum curvature condition. This force, when acting through the leading radius of the casing shoe, would generate a large compressive stress on the rock formation, possibly enough to cause the casing to 'dig in' to the formation instead to traversing through the curve. Consequently, a need exists to provide a solution against digging into the well formation.

SUMMARY OF THE INVENTION

Most casing 'shoes' or leading edge surfaces are radiused, but still represent a fairly small contact area. Therefore large deflection forces result in large compressive stress on the downhole rock formation. If the stress is greater than the strength of the rock formation, the casing will not deflect, but will instead attempt to go straight and will dig into the formation, preventing the casing from travelling down the wellbore.

Potential solutions to the problem are either to increase the contact area or reduce the force required to deflect the casing to allow the shoe or nose of the casing to follow the wellbore. The present invention provides a solution to decrease the deflection force required by including a short, 20 to 500 ft, guiding section in front of the normal casing with a lower stiffness than the casing.

Stiffness of the casing is represented by the product of the modulus of elasticity (E) and area moment of inertia (I). Lowering the stiffness can be accomplished by attaching a short (20 to 500 ft) cylindrical or tubular 'guide' in front of the casing that has stiffness (EI) that is about 5% to about 80%, and more preferably about 5% to about 25% of the stiffness of the casing to be run. The lower stiffness of the leading cylindrical or tubular guide section would allow it to more easily deflect and travel down the intended wellbore without causing undue stress on the formation. Once this lower stiffness section had entered the curved portion of the wellbore, it would be able to distribute the additional bending force required to deflect the higher stiffness casing behind it and therefore prevent the casing from 'digging in' to the wellbore and rock formations.

DETAILED DESCRIPTION OF THE INVENTION

Figure 1:
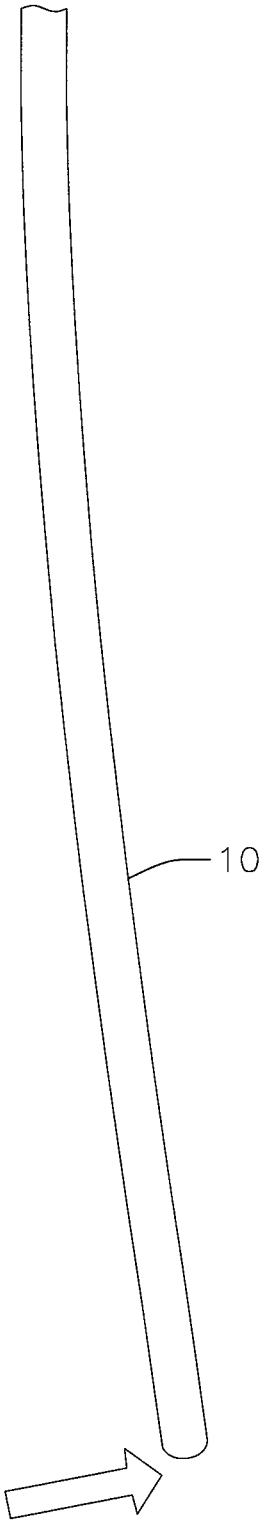
FIG. 1 is a side view of tubular casing illustrating deflection due to stress applied to the leading edge of the casing when engaging curved wellbores.
Figure 2:
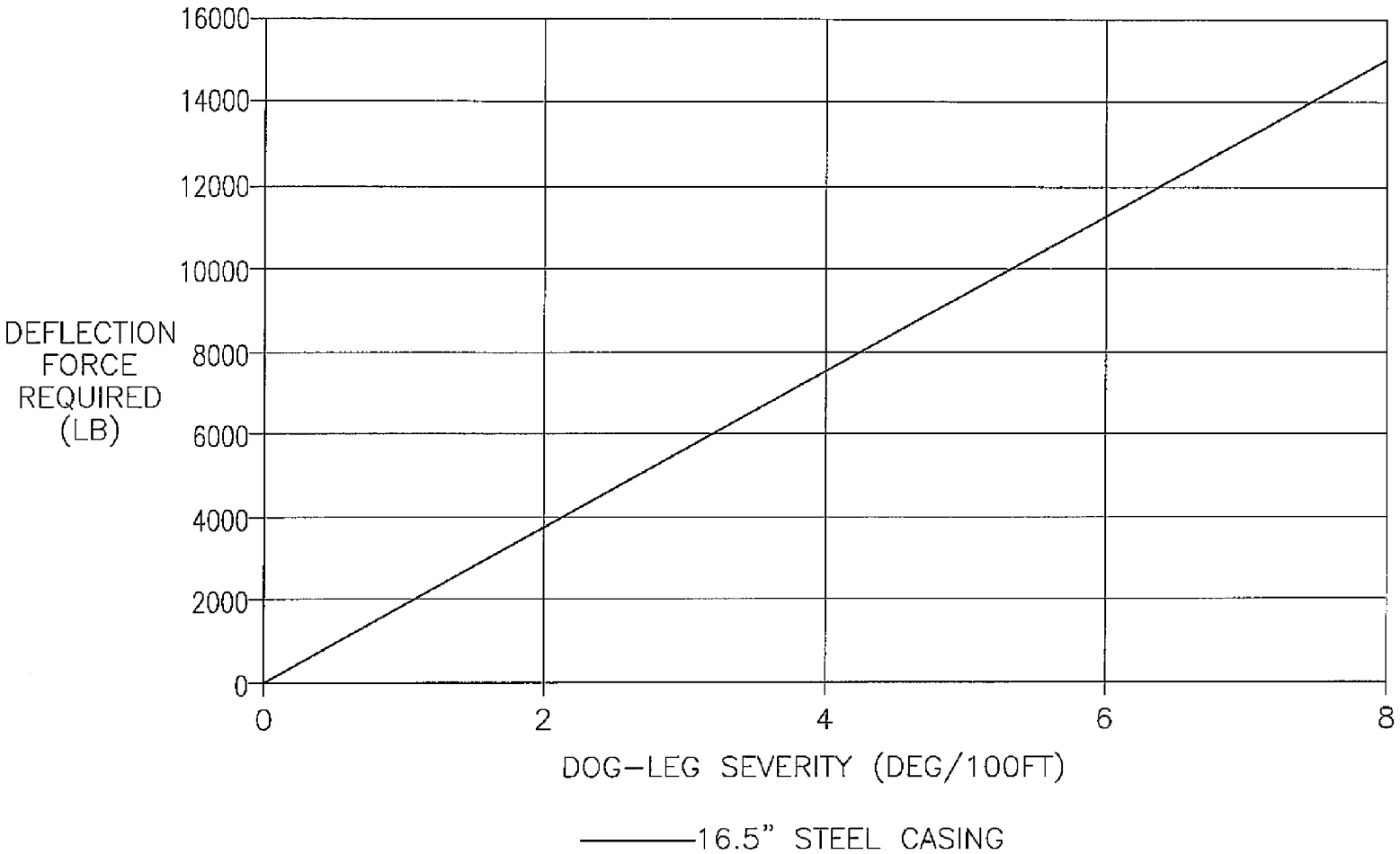
FIG. 2 is a graph illustrating deflection forces at the casing nose through various wellbore curvatures.
Figure 3:
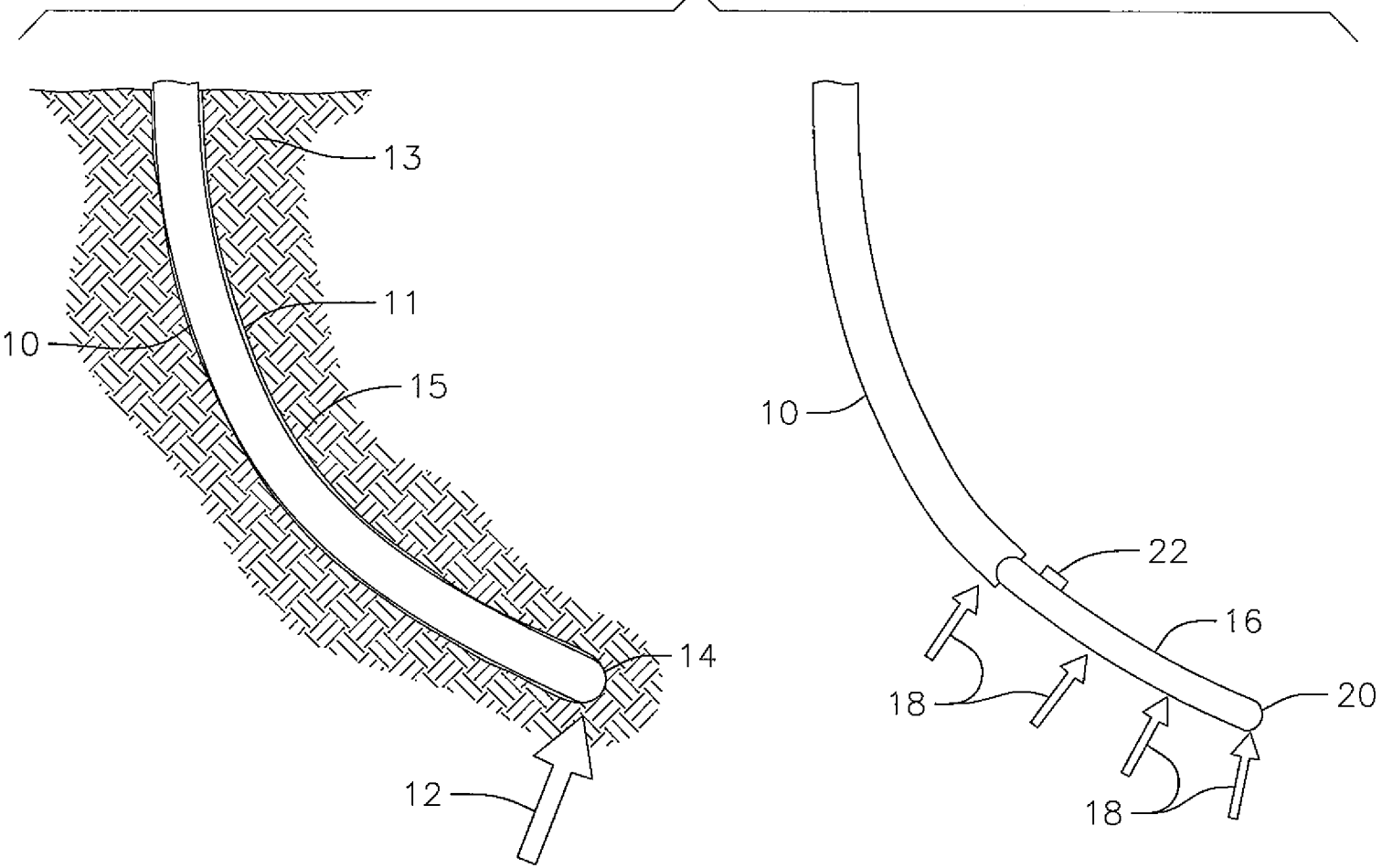
FIG. 3 is a schematic view of casing deflection with and without a flexible casing guide.

As shown in FIG. 3, running normal wellbore casing 10, which lines and is parallel to a wellbore 11, requires a large deflection force 12 at the leading edge or shoe 14 as shown by arrow 12. Most casing shoe or leading edge surfaces 14 are radiused, but still represent a fairly small contact area. Consequently, large deflection forces result in large compressive stress on the downhole formation 13. To reduce the force 12 required to deflect the casing 10 to allow the shoe 14 of the casing to follow the wellbore 11, a flexible casing guide 16 is positioned at the leading edge or shoe 14 of the casing. The flexible casing guide 16 requires less force 18 to deflect and therefore follow the curved section 15 of the wellbore. The length and stiffness of the flexible casing guide distributes the normal casing deflection force thereby reducing the risk of sticking the casing through a curved wellbore section. The flexible casing guide 16 can be a short cylindrical guiding section, for example 20 to 500 ft long, extending from an end of the normal casing and has a lower stiffness than the casing. The lower stiffness of the casing guide is about 5% to about 80%, and more preferably about 5% to about 25% of the stiffness of the casing. The lower stiffness of the leading cylindrical or tubular guide section would allow it to more easily deflect and travel down the intended wellbore without causing undue stress on the formation. Typically the leading edge 20 of the flexible casing guide would also be curved or radiused.

One embodiment of this invention would be to produce a section of aluminum tubing as the flexible casing guide 16. Because the modulus "E" of aluminum is approximately 37% of steel, so too would be the stiffness of aluminum tubing with the same geometry as the steel casing to be run.

In other embodiments, fiber reinforced composites such as glass, aramid, or carbon fiber with a thermoplastic or thermoset polymer matrix could be utilized to produce a cylindrical guide with a reduced stiffness compared to steel. As an example, glass reinforced epoxy has a typical modulus that is approximately 9% of steel, but the stiffness of these composites can be adjusted by changing the fiber material, fiber orientation and fiber volume fraction to match any desired modulus or elasticity.

Other potential solutions include reducing the OD or wall thickness of the guide which would further reduce area moment of inertia and therefore the stiffness of the guide. In addition, the guide could be created so that the leading edge stiffness is on the lower end of the range (about 5% to about 15% of casing stiffness) with the guide's stiffness increasing as it approaches the junction with the steel casing to provide support to enable the transfer of the deflection force from the casing to the guide so that the stress on the formation required to deflect the casing down the wellbore does not exceed the strength of the formation. The diameter of the guide will depend on the diameter of the casing, however the guide can range in diameter sizes from about 3 inches to about 30 inches.

Because the guide is positioned at the end of the casing string, it may also have the features of the bottom of most casing strings. It should have a radius or chamfer on the leading edge or 'shoe' to provide a ramp to enable the generation of the deflection force, and to spread out the force by increasing the contact area at the leading edge as much as possible. The guide may also have 'auto fill' valves 22 or other equipment to enable the casing to fill with fluid as it enters the hole, but also enable cementing after the casing has been run to its final depth. The guide can be connected to the casing by a threaded connection.

EXAMPLE EMBODIMENT OF THE FLEXIBLE CASING GUIDE

Casing to be run:
Steel with a 16.5 inch OD and 14.8 inch ID.
I=pi/64 (OD^4-ID^4)=1291 in^4
E=29,000,000 lb/in^2.
Stiffness (EI)=37440 million lb-in^2
Flexible Casing Guide:
Aluminum with a 16 inch OD and 15 inch ID.
I=732 in^4
E=10,600,000 lb/in^2
Stiffness (EI)=7760 million lb-in^2

Figure 4:
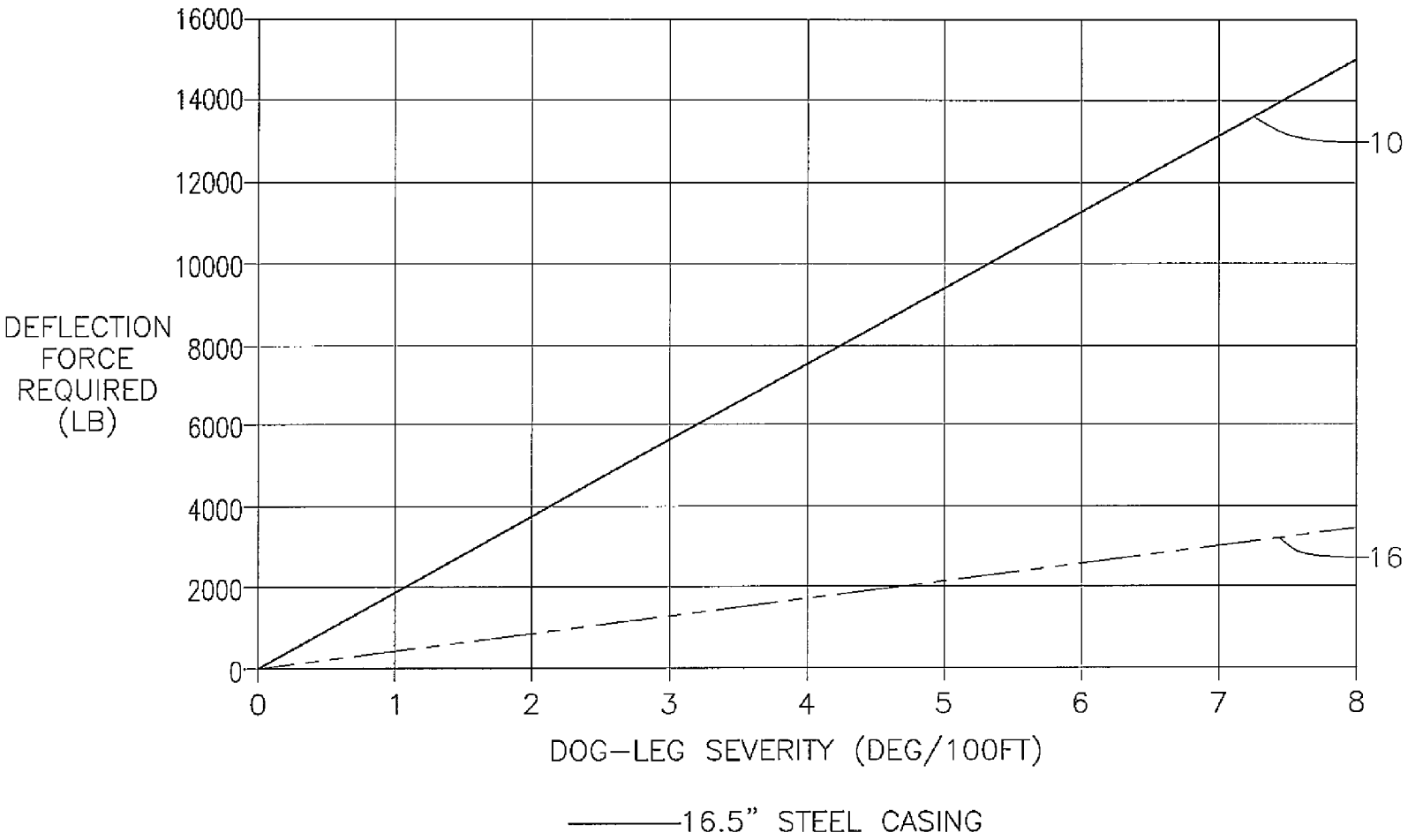
FIG. 4 is a graph illustrating a comparison of the deflection forces of a casing including a flexible casing guide.

In this example, the guide stiffness is 21% of casing stiffness. A comparison of the deflection force required to bend the casing versus the flexible casing guide is shown in FIG. 4.

The flexible casing guide 16 has about 5% to about 80% of the stiffness (EI) of the steel wellbore casing 10 that is to be run and preferably would have about 10% to about 50% of the stiffness of the casing. The guide may have increasing stiffness closer to the casing. The guide may use lower modulus (E) material, or a design with lower area moment of inertia (I), or both.

The guide is constructed out of a material that is lower in modulus (E) compared to steel casing and can include aluminum, fiber reinforced composites such as fiberglass, carbon, or Kevlar, or titanium. The guide utilizes a lower area moment of inertia (I) compared to steel casing, through having a smaller OD, a thinner wall thickness, and/or a narrowed cross section.

The length of guide is determined based on strength of the formation, curvature of the wellbore, and/or the stiffness of casing to be run, etc. The length will be between 20 to 500 ft, preferably between 40 to 200 ft. FEA analysis and calculation of EI (stiffness) is used to determine deflection loads. Evaluation of formation, well shape/wellpath data, and casing will affect length. Lower formation strength equals less length required. Stiff, large diameter, heavy wall casing equals greater length required.

The guide does not need to be pressure tight and auto fill and float equipment could be located between the casing and the guide. In addition the guide could include ports to circulate cement. The guide may include possible steel connections or a cross-over to allow easy makeup of the guide on the rig to reduce risk of cross-threading or galling when making up threaded connections. The flexible casing guide may also have low-friction inserts or materials to decrease running friction.

The flexible casing guide allows large diameter casing to be run and will minimize the risk of the casing getting stuck while running through a dog-leg or curvature in the wellbore. The guide may be used in directional deepwater wells using large, very stiff casing strings, particularly in deepwater wells with a build section or for a need in vertical wells with unplanned dog-leg or wellbore curvature. The guide may also be used in horizontal wells, which have high build rates and dog-leg severity which requires relatively stiff casing to traverse the build section. The flexible casing guide would allow casing to more smoothly run through the 10-15 deg/100 ft build section without getting stuck or digging in to the formation.

Figure 5:
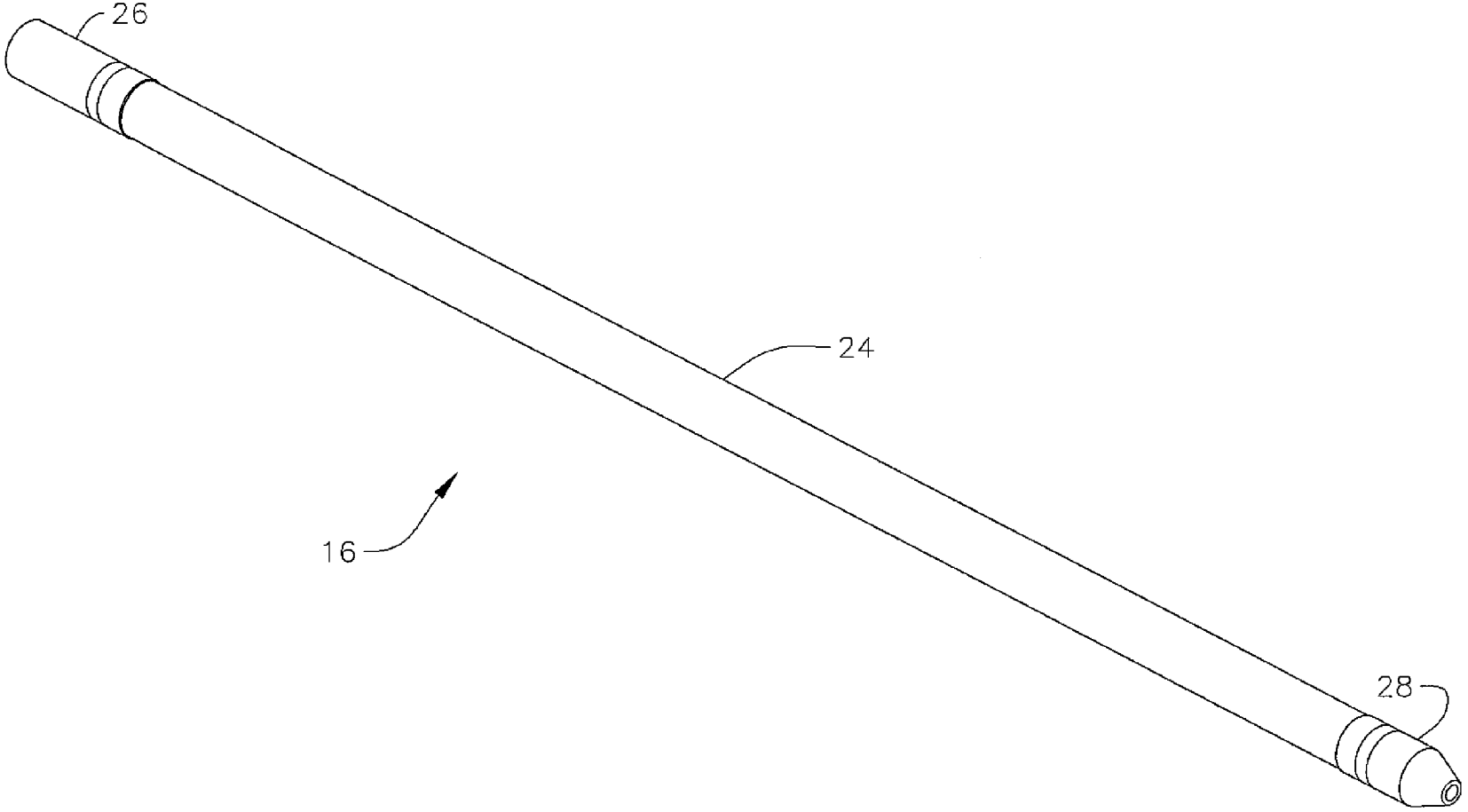
FIG. 5 is a perspective view of an alternative embodiment flexible casing guide of the present invention.

As shown if FIG. 5, the flexible casing guide 16 comprises a tube section 24, a casing connection section 26, and a nose assembly 28. The casing connection section 26 is positioned on an end of the tube section 24 for connection to the casing and nose assembly 28 is positioned on an opposite end of the tube section 24. The tube section 24 can be a composite material including a filament wound glass with vinyl ester epoxy resin. The composite material has a UV protection applied and has a temperature rating of 220 degrees Fahrenheit. For a seven inch diameter example, the tube section would have a 0.5 inch nominal wall thickness.

Figure 6:
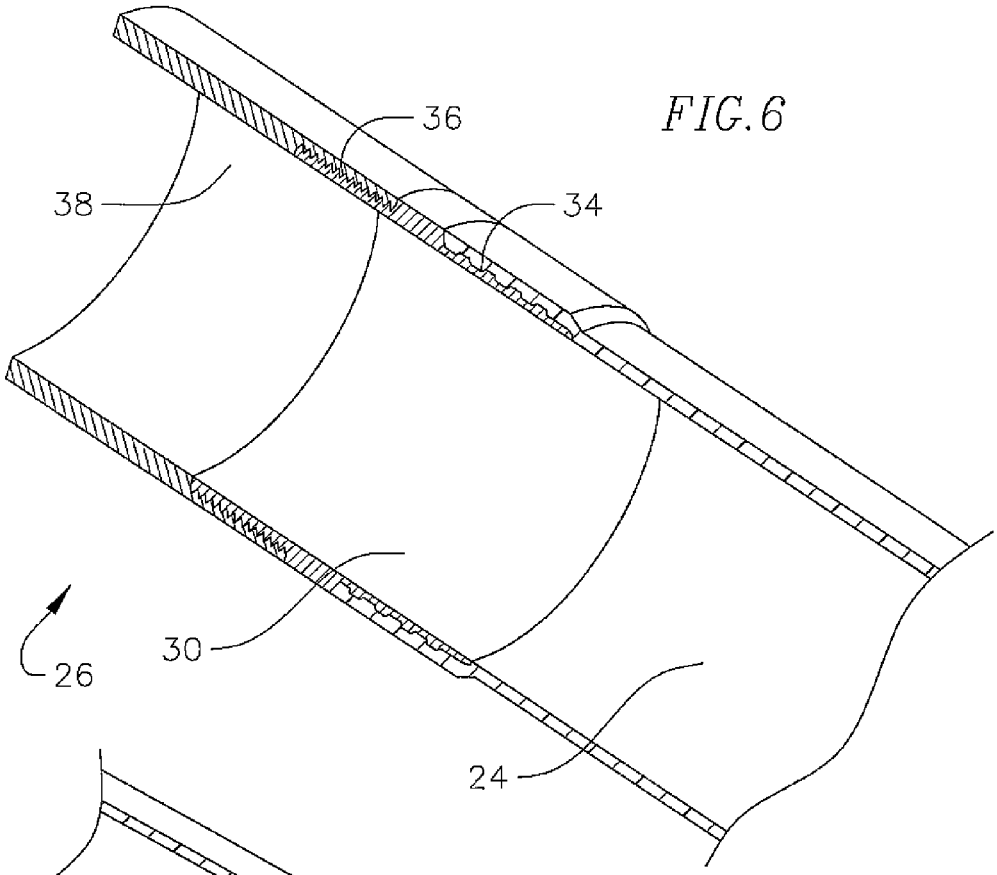
FIG. 6 is a cross-sectional detail view of the guide of FIG. 5 illustrating the connection to the casing.
Figure 7:
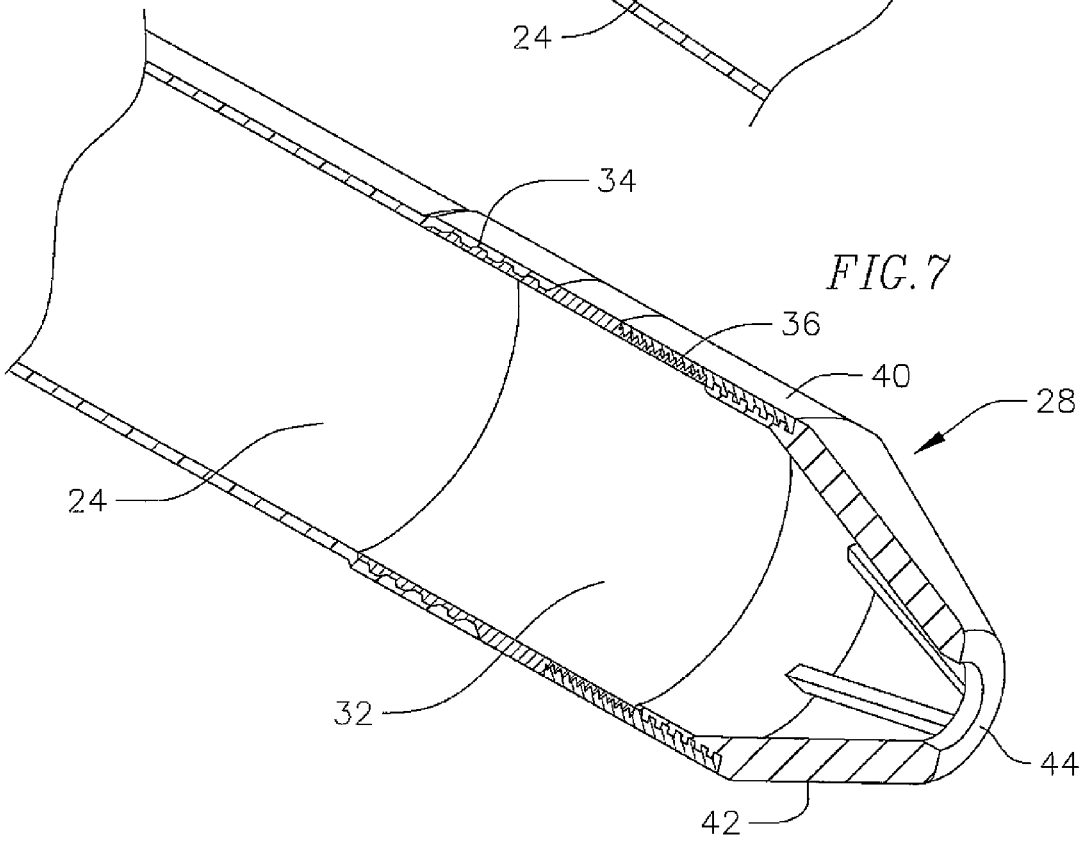
FIG. 7 is a cross-sectional detail view of the opposite end of the guide.

As seen best in FIGS. 6 and 7, the tube section 24 includes aluminum end connectors 30 and 32 positioned on either end of the tube section. One end of the aluminum end connectors includes ribs 34 which are features to lock the composite tube structure to the end connectors. The end connectors 30 and 32 are 6061-T6 aluminum which are anodized for corrosion protection and adhesion to the composite tube. The opposite ends of the aluminum connectors are threaded 36 for connection of a steel crossover 38 and the nose assembly 28.

The steel crossover 38 includes threads to mate with threads 36 to attach to the aluminum connector. The opposite end of the steel crossover can include whatever type of connection is necessary for attachment to the casing or other applications.

The nose assembly 28 includes an aluminum connector 40 having threads to connect to threads 36 for aluminum connector 32. The nose assembly further includes a one piece polyurethane nose section 42 having a conical taper to allow easy passage into cutting beds and through liner tops, etc, while maintaining some flexibility to distribute point loads. The nose section 42 includes an opening 44 positioned in an end surface of the nose section.

The preferable stiffness of the flexible casing guide 16 is about 5% to about 25% of the stiffness of the casing to be run. For an embodiment which uses a low modulus material, such as glass fiber reinforced composite using a thermoset matrix material, if the low modulus material were bonded or joined directly to the high modulus steel material, the stresses would be very high. Consequently, the transition between the very stiff high modulus steel casing and the low modulus composite material, a material with an intermediate modulus or stiffness is used to reduce the stress levels at the interface. By bonding or joining the composite to aluminum, the interface stresses are greatly reduced. Consequently, the composite tube is formed around an aluminum interface or connector, approximately 1 to 4 feet long which is then joined to the steel crossover. As indicated, the aluminum connectors include circumferential protrusions or ribs and the aluminum connectors are placed on a mandrel and the composite material is wound onto the cylindrical mandrel and the aluminum connectors. When the composite material is cured, the ribs serve to lock the composite tube onto the aluminum connector. In this embodiment, the steel crossover has an $E=30\times10^6$ PSI, the aluminum connector has a $E=10\times10^6$ PSI and the glass fiber composite tube has a $E=1.0\times10^6$.

Figure 8:
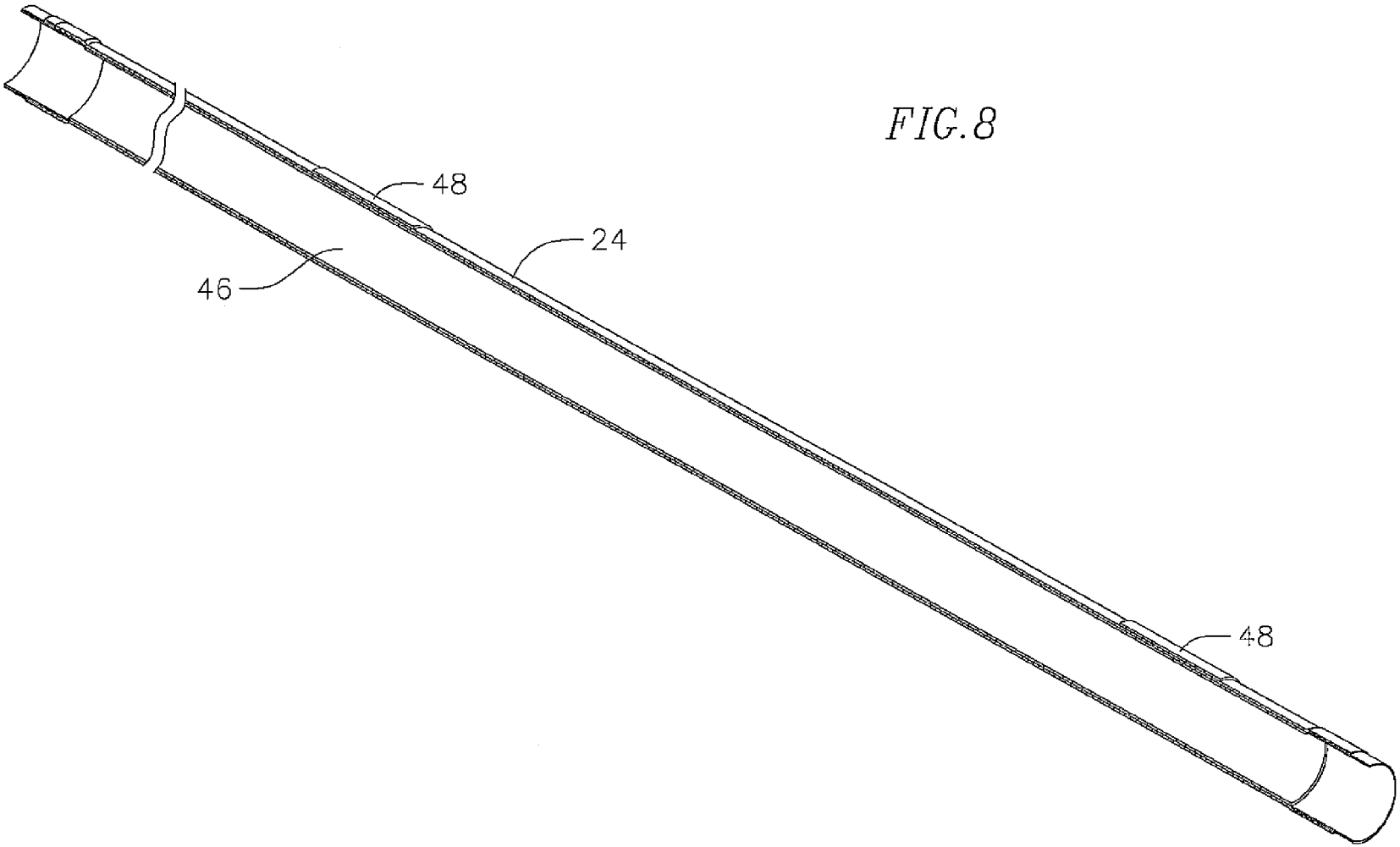
FIG. 8 is a cross-sectional view of the guide of FIG. 5 illustrating an internal liner.
Figure 9:
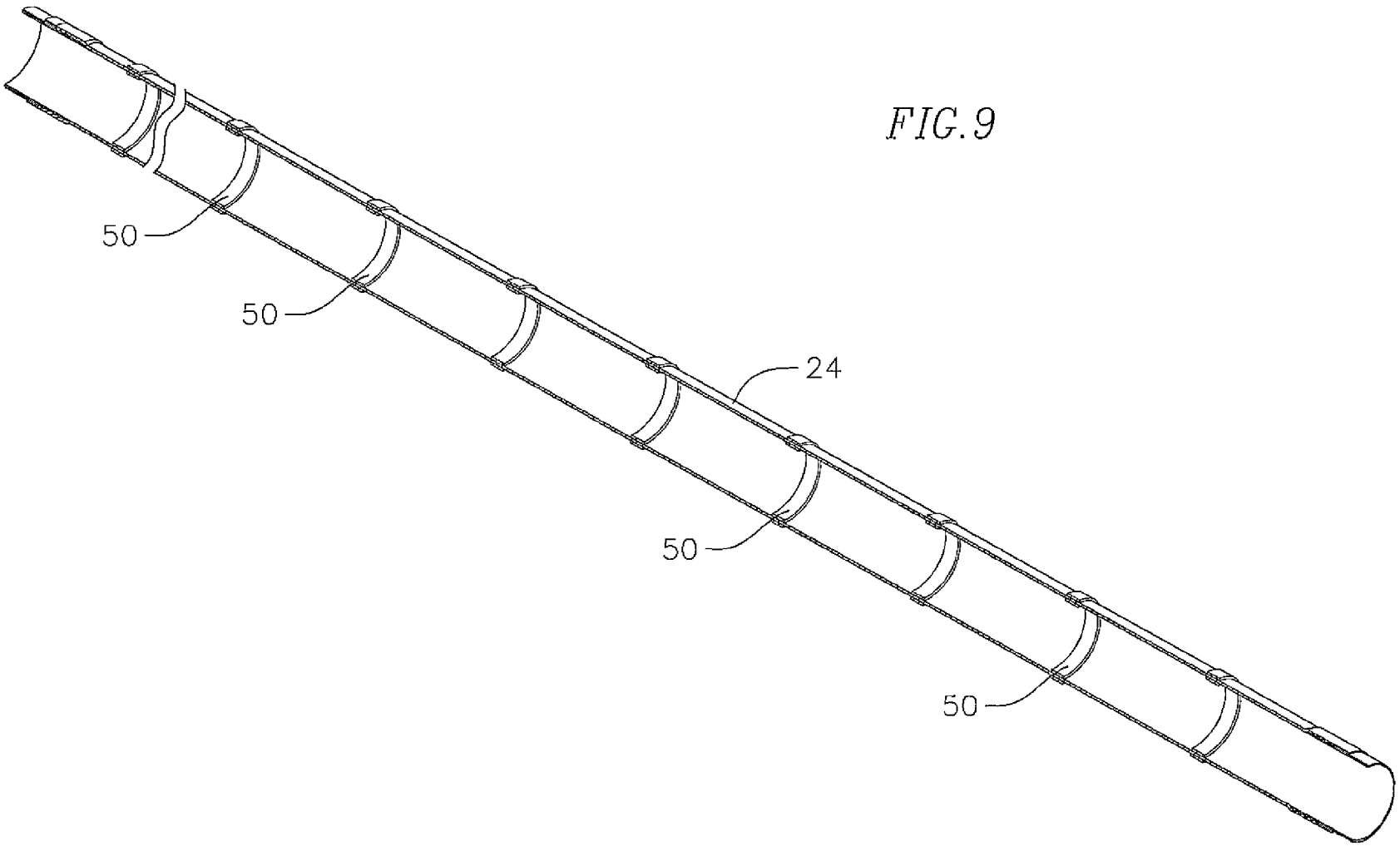
FIG. 9 is a cross-sectional view of the guide of FIG. 5 illustrating compression rings.

As shown in FIG. 8, tube section 24 can include a liner 46 to prevent wear and leakage or gas migration out of the tube section 24. The liner 46 is a thin polymer or metallic lining on the ID of the tube. Alternatively the liner could be on the outside diameter of the tube. A suitable polymer for the liner could be an ultra high molecular weight polyethylene or other thermoset of thermal plastic material. Alternatively circumferential or longitudinal pads 48 can be positioned on the outside diameter of the tube section 24 to reduce running friction or to prevent wear. The material suitable for pads 48 can be low friction or long wearing polymer or metallic elements, such as ultra high molecular weight polyethylene. As shown in FIG. 9, the tube section 24 can include a plurality of compression rings or segments 50 spaced along the internal diameter of the tube section 24 to increase stiffness, strength and/or wall thickness to increase the collapse pressure rating of the tube section. Collapse strength of thin-walled, large diameter tubes is an instability related phenomenon related to the stiffness of the material, the thickness and the diameter. The compression rings or segments improve collapse strength. The circumferential segments or rings 50 would be made from a higher stiffness material and/or higher strength material than the tube section 24 itself to provide flexibility with improved collapse strength.

While the present invention has been described and illustrated with respect to several embodiments thereof, it is to be understood that changes and modifications can be made therein which are within the intended scope of the invention as hereinafter claimed.

What is claimed is:

1. A flexible wellbore casing guide for aiding insertion of wellbore casing within a wellbore having deviation from vertical locations comprising:

a tubular body positioned at and connected to a bottom end of a wellbore casing which is adjacent to and lines the wellbore having a lower stiffness than the wellbore casing whereby the casing guide deflects at the deviation from vertical locations of the wellbore as the wellbore casing is inserted into the wellbore thereby allowing the wellbore casing also to deflect at the deviation from vertical locations as the wellbore casing is inserted into the wellbore.

2. The casing guide of claim 1, wherein the guide is a section of aluminum casing.

3. The casing guide of claim 1, wherein the guide is a section of fiber reinforced composite tubing.

4. The casing guide of claim 3, wherein the guide includes aluminum connectors positioned at either end of the guide.

5. The casing guide of claim 4, wherein the guide has a nose section having a radius or chamfered leading edge connected to one of the aluminum connectors.

6. The casing guide of claim 4, wherein a steel crossover is connected to one of the aluminum connectors.

7. The casing guide of claim 1, wherein the guide has an outside diameter or wall thickness less than a wellbore casing outside diameter or wall thickness.

8. The casing guide of claim 1, wherein the guide includes an auto fill valve.

9. The casing guide of claim 1, wherein the guide has an increasing stiffness along its length.

10. The casing guide of claim 1, wherein the guide has a diameter from about 3 inches to about 30 inches.

11. The casing guide of claim 1, wherein the tubular body includes a liner to prevent wear and leakage or gas migration.

12. The casing guide of claim 1, wherein the tubular body includes wear pads positioned on an outside diameter of the tubular body.

13. The casing guide of claim 1, wherein the tubular body includes a plurality of compression segments spaced along a length of the tubular body.

14. A wellbore casing comprising:

a first section of tubular casing adjacent to and lining a wellbore; and a second section of the tubular casing positioned at and connected to an end of the first section of tubular casing having a lower stiffness than a stiffness of the first section;

whereby the second section of tubular casing deflects at locations in the wellbore that deviate from a vertical direction as the wellbore casing is installed in the wellbore thereby allowing the first section of tubular casing to also deflect at the locations in the wellbore that deviate from the vertical direction during insertion into the wellbore.

15. The wellbore casing of claim 14, wherein the second section of tubular casing is aluminum casing.

16. The wellbore casing of claim 14, wherein the second section of tubular casing is fiber reinforced composite tubing.

17. The wellbore casing of claim 16, wherein the tubing includes aluminum connectors positioned at either end of the tubing.

18. The wellbore casing of claim 17, wherein the second section of tubular casing has a nose section having a radius or chamfered leading edge connected to one of the aluminum connectors.

19. The wellbore casing of claim 17, wherein a steel crossover is connected to one of the aluminum connectors.

20. The wellbore casing of claim 14, wherein the second section of tubular casing has an outside diameter or wall thickness less than an outside diameter or wall thickness of the first section of tubular casing.

21. The wellbore casing of claim 14, wherein the second section of tubular casing includes an auto fill valve.

22. The wellbore casing of claim 14, wherein the second section of tubular casing has an increasing stiffness along its length extending towards the first section of tubular casing.

23. The casing guide of claim 14, wherein the second section of the tubular casing has a diameter from about 3 inches to about 30 inches.

24. The wellbore casing of claim 14, wherein the second section of tubular casing includes a liner to prevent wear and leakage or gas migration.

25. The wellbore casing of claim 14, wherein the second section of tubular casing includes all wear pads positioned on an outside diameter of the second section of tubular casing.

26. The wellbore casing of claim 14, wherein the second section of tubular casing includes a plurality of compression segments spaced along a length of the second section of tubular casing.

* * * * *